United States Patent [19]

Taylor

[11] 4,035,164

[45] July 12, 1977

[54] METHODS FOR REMOVING CHARGED AND NON-CHARGED PARTICLES FROM A FLUID BY EMPLOYING A PYROLLECTRIC FILTER

[75] Inventor: Allen L. Taylor, Woodbury, Minn.

[73] Assignee: Minnesota Mining and Manufacturing Company, St. Paul, Minn.

[21] Appl. No.: 527,950

[22] Filed: Nov. 29, 1974

[51] Int. Cl.[2] ..... B03C 3/64

[52] U.S. Cl. ..... 55/11; 55/12; 55/14; 55/149; 55/154; 55/528; 131/262 B; 252/500; 428/913

[58] Field of Search ..... 55/11, 12, 14, 131, 55/154, 155, 157, 103, 354, 522, 528.2, 149, 101; 161/410, 189; 317/2 E, 2 F; 131/262 B; 252/500; 428/913

[56] References Cited

U.S. PATENT DOCUMENTS

| | | | |
|---|---|---|---|
| 2,067,822 | 11/1937 | Biederman | 55/131 X |
| 2,535,697 | 12/1950 | Roos | 55/154 X |
| 2,724,457 | 11/1955 | Besser | 55/103 |
| 3,067,078 | 12/1962 | Gluck | 161/189 X |
| 3,375,638 | 4/1968 | Ungler | 55/149 X |
| 3,487,610 | 1/1970 | Brown et al. | 55/130 |
| 3,701,236 | 10/1972 | Rotsky et al. | 55/149 X |
| 3,769,096 | 10/1973 | Shkin et al. | 252/500 X |
| 3,877,308 | 4/1975 | Taylor | 317/247 X |

*Primary Examiner*—Frank W. Lutter
*Assistant Examiner*—David L. Lacey
*Attorney, Agent, or Firm*—Cruzan Alexander; Donald M. Sell; James V. Lilly

[57] ABSTRACT

Processes for attracting charged and non-charged particles from a fluid by means of a pyroelectric filtering medium.

6 Claims, 2 Drawing Figures

METHODS FOR REMOVING CHARGED AND NON-CHARGED PARTICLES FROM A FLUID BY EMPLOYING A PYROLLECTRIC FILTER

BACKGROUND OF THE INVENTION

1. Field of the Invention

This invention relates in general to methods and means for removing charged and non-charged particles from fluid. More particularly, it relates to methods and means for removing charged and non-charged particles from fluid by means of a filter containing a pyroelectric filtering medium.

2. Description of the Prior Art

Particle filters have been used in the past to remove particulate matter from various fluid media. For example, they have been used as filters in fans, dust suction equipment, motor exhausts, cigarettes, gas masks, air filters, furnace filters, etc. Generally, particle filters may be categorized as either mechanical filters or electrically charged (electrostatic) filters.

Mechanical particle filters are designed to remove particulate matter by means of special mechanical structures and combinations of filtering media. However, such filters are often of limited usefulness because if fine filtering action is necessary, they become clogged with particulate matter relatively quickly and thereafter offer a great deal of resistance to fluid flow.

Electrostatic filters are designed to remove particulate matter by means of electrical attraction between the particles to be removed and the filtering medium. They may be made entirely from an electrostatically charged filtering medium, or optionally they may include a filtering medium combined with various other components, such as fibers or filaments to form a woven filter. Additionally, they must be used in various configurations such as webs, parallel layers of films, spheres, etc.

Known electrostatic filter media are generally formed of dielectric materials often referred to as electrets and made from such substances as carnauba wax, insect wax, spermaceti, acrylics, polystyrene, and various ferroelectric materials. When electrets are polarized, a static electric charge is produced on the surfaces thereof. The five most common types of polarization are atomic polarization, dipole polarization, interfacial polarization, space-charged polarization, and external polarization. These types of polarization are semi-permanent and are more fully discussed in Electret Devices for Air Pollution Control (T. Kallard ed. 1972).

Atomic polarization occurs when the negative electronic cloud of a dielectric material is displaced relative to its positive nucleus as a result of the application of an electric field that produces a small electric moment having a short lifetime. Dipole polarization occurs when the molecules of a dielectric material that have an electric moment align along the direction of an applied electric field producing an electric moment of the entire dielectric. Interfacial polarization occurs when an electric field is applied to a non-homogeneous dielectric material. Free charge carriers in the non-homogeneous dielectrics are relatively free to move only within single microscopic domains. Consequently, the carriers build up along the barriers of the domains resulting in the creation of a dipole moment. Space-charged polarization occurs from ionic conduction currents in homogeneous dielectric materials and the formation of space-charge clouds in the electrode regions of an applied electric field. External polarization occurs from the injection of equal and opposite charges on opposing surfaces of a dielectric material.

Polarization may be most effectively accomplished by heating the dielectric material to increase its conductivity, applying a high voltage electric field to it, cooling it to room temperature while under the influence of the electric field, and removing the electric field. Application of the electric field causes the displacement of the electron cloud, alignment of the dipoles, movement of the free charge carriers, or the injection of the electrons into the dielectric. The higher the temperature of the dielectric the easier it is for polarization to occur. When the dielectric is cooled in the presence of the electric field, the electrically induced polarization is semi-permanently held therein.

Although prior art electrostatic filters have served satisfactorily in operation, they suffer from an inherent deficiency in having only limited lifetimes. Some of these filters have electret materials capable of holding their electrostatic charge for periods of time of up to about two years, but the electric field of such electret filters decreases in intensity with time and results in decreased filtering capabilities. More importantly, the electric field is also decreased as particles are attracted to the filter. Moreover, care must be taken in the preparation and handling of prior art filters to prevent neutralization of oppositely charged surfaces of their electrets or adjacent members, for example, by the creation of a conductive path.

Various electrostatic filters of the type described above are disclosed in U.S. Pat. Nos. 2,724,457; 2,740,184; 3,193,912; 3,307,332; 3,463,168; and 3,487,610. However, such patents do not disclose the use of a molecularly poled, temperature sensitive pyroelectric material as the filtering medium. Moreover they do not provide a filtering medium having a prolonged lifetime.

SUMMARY OF THE INVENTION

In accordance with the present invention and in one embodiment thereof, there is provided a particle filter medium for attracting charged and non-charged particles from a fluid that is formed of a poled, temperature sensitive pyroelectric material that produces electrostatic charges on its planar surfaces when its ambient temperature is varied, the charges produced on one side of the pyroelectric material being opposite in polarity to the charges on the opposite side of the pyroelectric material.

Also, provided herein is a process for attracting charged and non-charged particles from a fluid by utilizing the particle filter of the present invention by varying the ambient temperature of the filter and passing the fluid within a close proximity of such filter medium.

Also provided herein is an alternative process for attracting charged and non-charged particles from a fluid by utilizing the particle filter of the present invention by varying the ambient temperature of the filter, neutralizing the electrostatic charges produced, and passing the fluid within a close proximity of the filter medium.

The present invention does not require the maintenance of electrostatic charges on the pyroelectric filter media for long periods of time as each change in its ambient temperature produces new electrostatic charges on its planar surfaces. Consequently, the dissipation of the charge as a result of time is not a problem. The poled, pyroelectric filter media of the present invention contrasts sharply with filter media of prior art filters that are electrostatically charged by semi-permanently polarizing the dielectric material by means of an externally applied electric field. Additionally, the pyroelectric filtering media of the present invention may be removed, washed and disinfected without affecting their filtering properties. Because of their electrostatic charge regeneration capability and washability, the pyroelectric filter media of the present invention have prolonged lifetimes.

The present invention can be used in a wide variety of applications wherein it is desirable to remove charged and non-charged particulate matter from a fluid. For example, it can be applied to fans, dust suction apparatus, motor exhausts, gas masks, dust masks, cigarettes and other smoking paraphernalia, air filters, furnace filters, etc. Moreover, the pyroelectric filtering media of the present invention can be combined with other substances that absorb or adsorb, thereby collecting gaseous impurities. Representative examples of such substances include granular charcoal, sand, resins, etc.

The foregoing and other advantages of the present invention will appear from the following description. In the description, reference is made to the accompanying drawings, which form a part hereof, and in which are shown by way of illustration, and not of limitation, specific forms in which the invention may be embodied. Such embodiments do not represent the full scope of the invention, but rather the invention may be employed in a variety of additional embodiments, and reference is made to the claims herein for interpreting the breadth of the invention.

BRIEF DESCRIPTION OF THE DRAWINGS

It is understood that like numbers in the figures refer to like parts in the embodiments of the invention.

DESCRIPTION OF THE PREFERRED EMBODIMENTS

Figure 1:
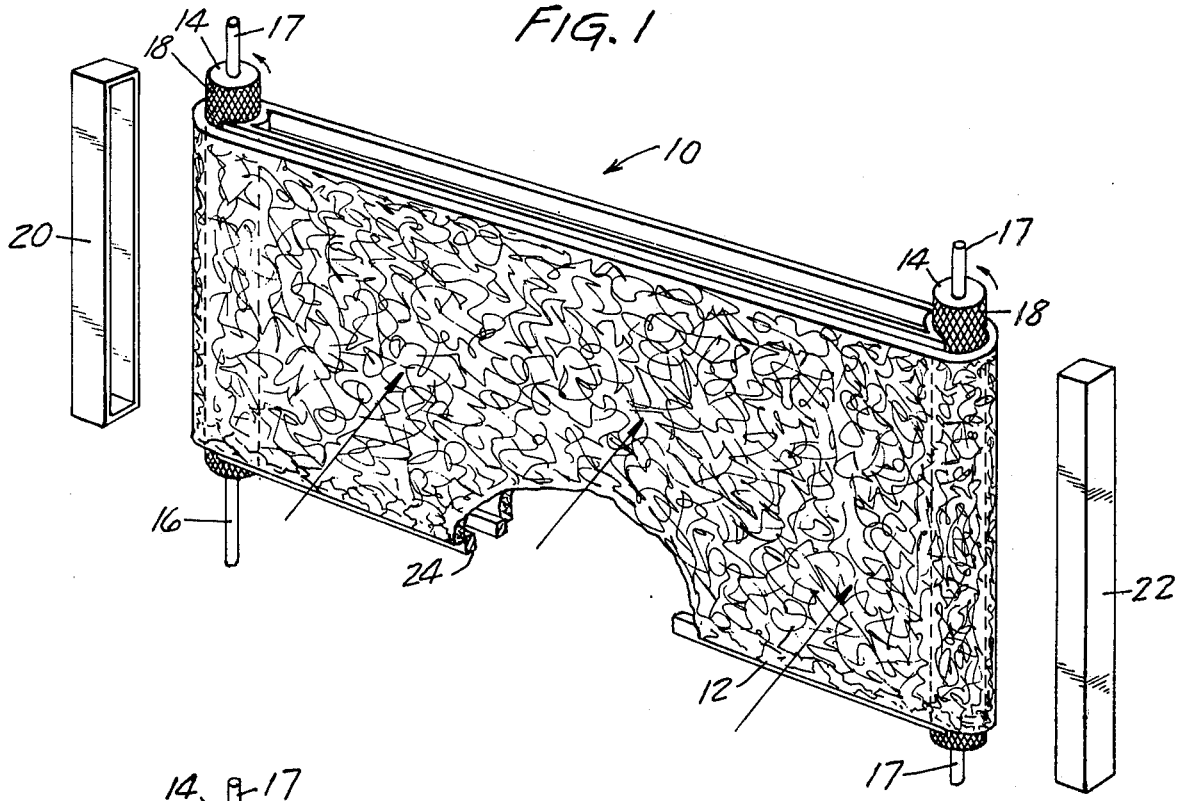
FIG. 1 is a perspective view in elevation of an embodiment of the invention including a continuous pyroelectric filter belt with portions cut away to show a separating frame.

Referring now specifically to FIG. 1, device 10 is shown which represents but one embodiment of the invention. The device 10 is particularly suited for use as a filter for fans, dust suction apparatus, motor exhausts, furnaces, air purifiers, etc. The word filter is used in a broad sense herein to include devices that remove particles from a fluid flow by modes known to those in the art. The device 10 comprises a continuous filter belt 12, disposed about two rotatable shafts 14 to lie near temperature varying means 20 and 22.

The filter belt 12 may be formed solely from a poled pyroelectric filtering medium or alternatively, it may include a poled pyroelectric filtering medium together with another type of filtering medium, binder, or substance which may absorb or adsorb gaseous impurities. For example, the poled pyroelectric filtering medium may be combined with the electrostatic filtering media known to the art. Alternatively, the poled pyroelectric filtering medium may be combined with a non-conductive adhesive into a sandwich-like configuration or into a mat-like structure in which strips of pyroelectric material are adhered together. Additionally, the pyroelectric material may be woven into a mat-like configuration or it may be combined with various fibrous binders.

The pyroelectric filtering medium of the belt 12 may be present in the form of crystals, grains, or sheets. Sheets that can be used may vary in width from ones that are very narrow to ones that are as wide as the filter belt 12 itself. When very wide sheets are provided, or when a number of narrow sheets or strips are placed closely together or are woven together, some means of providing a passage for the fluid to be filtered must be provided. This can be accomplished by perforating the sheets or webs or, by placing them in a spaced apart relationship.

As has been stated, poled pyroelectric materials exhibit the unique characteristic of developing electrostatic charges on their planar surfaces when subjected to a change in ambient temperature, with the charges developed on one surface opposite in polarity to those developed on the other surface.

Although a few pyroelectric materials have molecules that are naturally aligned in a poled relationship, normally the molecules of pyroelectric materials are not aligned in a poled relationship. They can be rearranged in orientation when a pyroelectric material is heated above a particular temperature known as the poling temperature. At the poling temperature, the molecules of a pyroelectric material will orient themselves in accordance with an applied electric field. The degree of molecular orientation is a function of the temperature to which the pyroelectric material is heated, the applied field strength and the length of time the field is applied. For example, substantial poling begins in polyvinylidene fluoride when it is heated to a temperature greater than 90° C and an electric field of at least 4000 volts per millimeter of thickness is then applied for approximately 15 minutes. Increasing the temperature and/or the applied electric field will progressively increase the degree of poling achieved up to a maximum of saturation.

Once a pyroelectric material is poled and then cooled below its poling temperature, the applied field may be removed and the molecules will remain as oriented by the applied field. The pyroelectric material will thereafter produce opposite electrostatic charges on its planar surfaces when its ambient temperature is increased or decreased. Care should be taken though to insure that the material is not heated above its poling temperature for extended periods since such a condition causes the poled molecules to return to a random orientation.

The pyroelectric filtering medium of the belt 12 may be formed from any material having pyroelectric properties and charge sustaining characteristics. For example, it may be a crystalline substance such as ZnO, CdS, CdSe, and SbSI. Alternatively, it may be a polymer such as polyvinylidene fluoride, polyvinyl fluoride, and other such non-crystalline materials such as lanthanum modified lead zirconate-titanate. Preferably, the filtering medium is polyvinylidene fluoride.

The dimensions of the device 10 are a matter of choice, keeping in mind, that for a given porosity of belt material, fluid flow through the filter belt 12 decreases as thickness of the filter belt 12 increases. To produce rotation of the filter belt 12 at least one of the shafts 14 may be attached to a rotating means (not shown) by means of arm 16. The arm 16, together with pins 17, may be disposed in supporting frame work (not shown) to prevent the shafts from moving in a vertical or horizontal fashion. Circumferential surfaces 18 of the rotatable shafts 14 are ribbed or knurled or otherwise modified to prevent slippage of the filter belt 12 on the shafts 14 as they rotate. The shafts 14 preferably comprise a non-conductive material so that they do not provide a conductive path to dissipate electrostatic charge generated on the pyroelectric filtering medium of the filter belt 12 when its ambient temperature is varied.

The belt 12 must be sufficiently porous to allow fluid to flow through it and must also be flexible so as to turn easily around the shafts 14. Preferably the shafts 14 should hold the belt sufficiently rigid to prevent contact of the front and back portions of the belt 12 due to the fluid flow. Alternatively, a rigid frame 24 may be provided between the shafts 14 to prevent such contact. It is preferred that the frame 24 be formed from a non-conductive material so as not to provide a conductive path by which the electrostatic charge generated on the filter belt may dissipate.

The process disclosed of attracting charged and non-charged particles from a fluid by means of the device 10 is accomplished by varying the temperature of the pyroelectric filtering material of the belt 12 by means of temperature varying means 20 or 22 which respectively heat and cool the belt 12, but both of which could cool or heat. Due to the poling of the pyroelectric filtering medium of the belt 12 a change in temperature results in the formation of an electrostatic charge thereon. A fluid to be filtered is then directed within a close proximity of the belt 12 as it is driven around the rotatable shafts 14. An enclosure (not shown) may be provided around the device 10 to insure that the fluid to be filtered must flow within close proximity of the filter belt 12. Charged particles in the fluid are immediately attracted to electrostatic charges of opposite polarity on the belt 12 thereby removing them from the fluid stream. When non-charged particles in the fluid encounter an electric field gradient produced by the belt 12 they are induced with a dipole moment and may then be attracted to the belt 12 thereby also removing them from the fluid stream.

In order to maintain an electrostatic charge on the belt 12, it is preferred to cycle the temperature of the belt 12 between temperatures $T_1$ and $T_2$. Because electrostatic charges are generated by the pyroelectric material of the belt 12 during a variation in temperature, it is necessary that either $T_1$ or $T_2$ be a temperature other than the original ambient temperature of the belt 12 and that the pyroelectric material of the belt 12 have a sufficient charge sustaining capacity to maintain a charge while passing between the temperature varying means 20 and 22. A difference between $T_1$ and $T_2$ of 1° C will produce 5 volts for each 25 microns of thickness of poled polyvinylidene fluoride pyroelectric material. Such temperature cycling may be accomplished by employing either or both of the temperature varying means 20 or 22. As the belt 12 passes the temperature varying means 20, the temperature will change toward $T_1$ thereby inducing an electrostatic charge of one polarity. As the belt 12 passes the temperature varying means 22, the temperature will change toward $T_2$ thereby inducing an electrostatic charge of opposite polarity to the first charge. The construction of the temperature varying means 20 and 22 is not critical to the present invention and they may be devices well known to the art for heating and cooling. For example, the temperature varying means 20 may be an electric heater while the temperature varying means 22 may comprise a fan.

Cycling the temperature of the pyroelectric belt 12 in this fashion offers other advantages. For example, as the belt 12 moves from one of the temperature varying means to the other, it will tend to change temperature by itself. This in turn will slightly diminish the electrostatic charge of the belt 12 and reduce the forces attracting particles which have been collected. By employing a cleaning stream of, for example, air the device 10 may then be cleaned thereby providing an efficient means of filtering the fluid medium. Subsequently, as the belt 12 reaches the other of the temperature varying means a new electrostatic charge will be generated so that the filtering capability of the belt 12 will be brought back up to a peak level.

Figure 2:
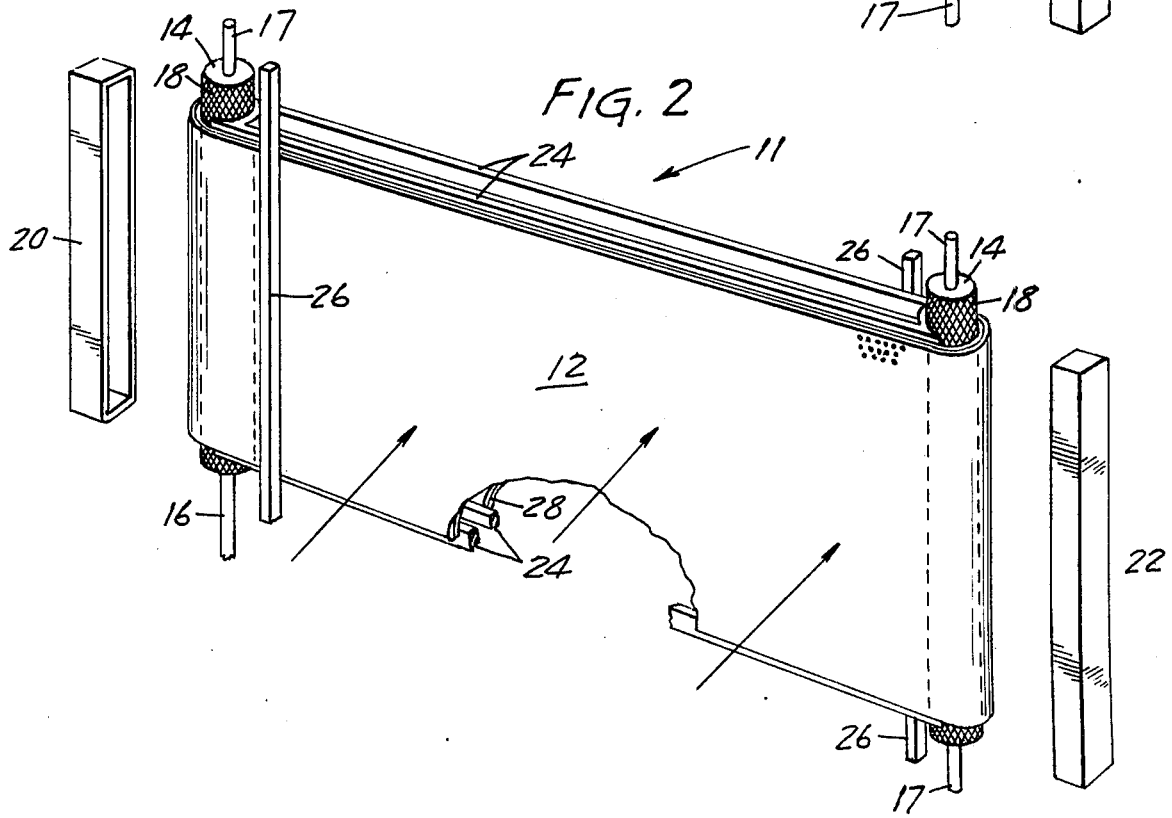
FIG. 2 is a perspective view in elevation of another embodiment of the invention including a static charge eliminating means with portions cut away to show a conductive layer on the filter belt.

Referring now specifically to FIG. 2, device 11 is shown which represents another embodiment of the invention. The device 11 is also suited for use as a filter for fans, dust suction apparatus, motor exhausts, furnaces, air purifiers, etc. The device 11 includes the parts which make up the device 10 plus electrostatic charge eliminating means 26 and an electrically conductive layer 28 applied to the inner surface of the pyroelectric material of the filter belt 12. The layer 28 is maintained at ground potential. The eliminating means 26 are located such that the outer surface of the filter belt 12 is presented to them shortly after the belt 12 has been exposed to the temperature varying means 20 and 22. Consequently, the eliminating means 26 are located on opposite ends of the device 11. The construction of the eliminating means 26 is not critical to the present invention and it may be any device known to the art for removing electrostatic charge. For example, the eliminating means 26 may comprise devices that eliminate static electrical charges by means of a stream of ionized air. Alternatively, they may comprise copper brushes that are electrically grounded. Other eliminating means for the removal of static electrical charges are known to the art and may be employed as the eliminating means 26.

The layer 28 may be any material known to the art as electrically conductive. For example, the layer 28 may be a layer of aluminum film. The layer 28 may be applied by evaporating it onto the inner surface of the pyroelectric material of the belt 12. The layer 28 must allow the passage of the fluid to be filtered. This can be accomplished by perforating the layer 28, or alternatively, the layer 28 can be formed of strips placed in a spaced apart relationship.

The process disclosed of attracting charged and non-charged particles from a fluid by means of the device 11 is accomplished by varying the temperature of the belt 12 by means of temperature varying means 20 or 22 which respectively heat and cool the belt 12, but both of which could cool or heat, to a temperature which is different than the original ambient temperature of the belt 12. As previously discussed with respect to the device 10, a change in temperature of the belt 12 results in the formation of an electrostatic charge thereon. One side of the pyroelectric medium is maintained at zero potential because the layer 28 is grounded. As the belt 12 is driven around the shafts 14 the other side of the pyroelectric medium is exposed to the eliminating means 26 thereby neutralizing the electrostatic charges on those portions of the belt 12 exposed to the means 26. A fluid to be filtered is then directed in a flow within a close proximity of the belt 12. The fluid changes the temperature of the belt 12 from that induced on it by means of the temperature varying means 20 or 22 and results in the formation of new electrostatic charges on the belt 12. Charged particles in the fluid are immediately attracted to electrostatic charges of opposite polarity on the belt 12 thereby removing them from the fluid stream. When non-charged particles in the fluid encounter an electric field gradient produced by the belt 12, they are induced with a dipole moment and may then be attracted to the belt 12 thereby also removing them from the fluid stream.

Neutralizing the electrostatic charges on the belt 12 in this fashion offers the advantage that since there are no charges on the belt 12 after neutralization there are no forces holding the particles that have been collected. By employing a cleaning stream of, for example, air maintained at the same temperature as the belt 12 immediately after neutralization, the device 11 may be cleaned thereby providing an efficient means of filtering the fluid. As the belt 12 is exposed to the fluid to be filtered new electrostatic charges will be generated so that the filtering capability of the belt 12 will be brought back up to a peak level.

The temperature of the belt 12 can be varied by means other than those shown in FIGS. 1 and 2. For example, the temperature of the fluid to be filtered may be cycled thereby changing the temperature of the filtering medium and creating electrostatic charges of varying polarity. Alternatively, the temperature of the filtering medium may be varied by contacting it with the rotatable shafts 14 maintained at different temperatures.

The present invention may be exemplified by still other embodiments. For example, the present invention may be utilized as a filtering mask for covering the nose and mouth of persons who must work in environments having impure air. In such application the temperature of the pyroelectric filtering medium is varied by the breathing process. As the person wearing the mask inhales the pyroelectric material cools producing a charge of one polarity and attracting charged and non-charged particles from the incoming air. As the person exhales the pyroelectric material heats up producing an electrostatic charge of the opposite polarity. The force of exhaling tends to force the collected particles from the mask increasing the mask's useful life.

Another example of the practice of the invention is in the area of tobacco smoke filters. In such cases the pyroelectric material is used as the filter in smoking paraphernalia to attract tars, resins, and other respiratory irritants. As the person using the smoking paraphernalia inhales the tobacco smoke through the filter the pyroelectric filtering medium cools producing an electrostatic charge and attracting charged and non-charged irritants before they enter the person's lungs. Numerous other examples of how the present invention may be utilized are possible and will be obvious to those skilled in the art as a result of this disclosure.

In addition to providing a filter that can be electrostatically charged at will and which is not, therefore, dependent upon the retention of electrostatic charges for a lengthy time in order to be useful, the present invention also provides a filter that may be easily washed, for example, with soap and warm water, without affecting its pyroelectric properties. Consequently, the present invention may be regenerated if it becomes fouled with particulated matter and has, therefore, a prolonged lifetime.

What is claimed is:

1. A process for removing charged and non-charged particles from a fluid flow by attracting said particles to a separator device wherein said device comprises a separating medium formed of a poled, temperature sensitive pyroelectric material having a first surface and a second surface wherein said pyroelectric material produces electrostatic charges on said surfaces when its ambient temperature is varied, the charges produced on the first surface of said pyroelectric material being opposite in polarity to the charges produced on the second surface thereof, which process comprises the steps of:

a. varying the ambient temperature of said separating medium; and b. passing the fluid flow within a close proximity of said separating medium so that said particles are attracted to said electrostatic charges on said pyroelectric material and removed from said fluid stream.

2. A process according to claim 1 wherein said pyroelectric material is formed from a polymeric material.

3. A process according to claim 1 wherein said pyroelectric material is formed from polyvinylidene fluoride.

4. A process according to claim 1 wherein said particle separator device further comprises a belt including said pyroelectric material, two rotatable shafts about which the belt is disposed, and at least one means of varying the temperature of said pyroelectric material of said belt.

5. A process for removing charged and non-charged particles from a fluid flow by attracting said particles to a separator device wherein said device comprises a separating medium formed of a poled, temperature sensitive pyroelectric material having a first surface and a second surface wherein said pyroelectric material produces electrostatic charges on said surfaces when its ambient temperature is varied, the charges produced on the first surface of said pyroelectric material being opposite in polarity to the charges produced on the second surface thereof, which process comprises the steps of:

a. varying the ambient temperature of said separating medium;

b. neutralizing the electrostatic charges produced on said first and second surfaces of the separating medium; and c. passing the fluid flow within a close proximity of said separating medium so that said particles are attracted to said electrostatic charges on said pyroelectric material and removed from said fluid stream.

6. A process according to claim 5 wherein said separator device further comprises a belt including said pyroelectric material wherein said pyroelectric material has a conductive layer applied to said first surface thereof and maintained at ground potential, a device for eliminating static electricity from portions of said second surface of said belt exposed thereto, two rotatable shafts about which the belt is disposed, and at least one means of varying the temperature of said pyroelectric material of said belt.

* * * * *